US005402105A

United States Patent [19]

Doyle et al.

[11] Patent Number: 5,402,105

[45] Date of Patent: Mar. 28, 1995

[54] GARAGE DOOR POSITION INDICATING SYSTEM

[75] Inventors: Matthew P. Doyle; Patrick J. Bukiri, both of Orland Park, Ill.

[73] Assignee: MAPA Corporation, Chicago, Ill.

[21] Appl. No.: 229,394

[22] Filed: Apr. 18, 1994

Related U.S. Application Data

[63] Continuation of Ser. No. 894,264, Jun. 8, 1992, abandoned.

[51] Int. Cl.[6] ..... G08B 1/08

[52] U.S. Cl. ..... 340/539; 340/545; 340/686; 340/689; 340/546; 49/31

[58] Field of Search ..... 340/539, 569, 545, 546, 340/825.69, 825.72, 686, 689; 49/25, 31

[56] References Cited

U.S. PATENT DOCUMENTS

| | | | |
|---|---|---|---|
| 3,611,333 | 10/1971 | Conigliaro | 340/569 |
| 3,827,038 | 7/1974 | Willis | 340/539 |
| 3,831,158 | 8/1974 | Rempel et al. | 340/539 |
| 4,074,269 | 2/1978 | Hartley | 340/539 |
| 4,090,182 | 5/1978 | Young | 340/539 |
| 4,124,847 | 11/1978 | Cashman | 340/545 |
| 4,536,751 | 8/1985 | Shigemitsu et al. | 340/545 |
| 4,583,081 | 4/1986 | Schmitz | 340/545 |
| 4,819,379 | 4/1989 | Kenzelmann et al. | 49/280 |
| 4,868,543 | 9/1989 | Binkley | 340/569 |
| 4,954,810 | 9/1990 | Llewellyn | 340/539 |

*Primary Examiner*—Donnie L. Crosland
*Attorney, Agent, or Firm*—Leydig, Voit & Mayer Ltd.

[57] ABSTRACT

A garage door position indicating system includes a tilt switch attached to a garage door, an RF transmitter coupled to the tilt switch, an RF receiver, and an indicator controlled by the RF receiver. The tilt switch supplies an enable signal to the RF transmitter at selected first tilt positions and blocks the enable signal at selected second tilt positions. The RF transmitter generates an RF signal in response to the enable signal. The RF receiver is responsive to the RF signal and controls an indicator to indicate the position of the garage door.

8 Claims, 3 Drawing Sheets

GARAGE DOOR POSITION INDICATING SYSTEM

This is a continuation of application Ser. No. 07/894,264 filed on Jun. 8, 1992, now abandoned.

BACKGROUND OF THE INVENTION

The present invention relates to overhead door position indicating systems.

Door alarm systems are known which are usable on doors, including garage doors. Typically, these systems include contact points between the door and the adjacent door jamb. As the door opens and the contacts are separated, a switch closes supplying power to an alarm circuit. These systems are generally hard-wired into the home/garage electrical system.

The use of a radio frequency (RF) transmitter with a motion detecting alarm system is disclosed in U.S. Pat. No. 3,831,158 to Rempel et al. When the door or window to which the device is secured moves, the motion detecting device moves to complete the circuit between a power supply and the RF transmitter. While detecting the motion of the object to which it is attached, this system is not capable of alerting one to the position of that object.

A status indicating system for use with an automatic garage door opener is disclosed in U.S. Pat. No. 4,583,081 to Schmitz. An indicator system comprising a pair of light emitting diodes hard-wired across up and down limit switches indicates the door position.

Additionally, various door alarm systems are known that require a mechanical connection between the movable door and an adjacent stationary door frame. Typically, these systems utilize the mechanical connection as a switch in an alarm circuit such that, when the door is opened, movement of the mechanical connection between the door and the frame triggers the alarm.

It is an object of the present invention to provide a garage door position indicating system which may be easily installed on any overhead door without requiring any changes to existing home wiring and without requiring any alignment or mechanical connection between the door and the adjacent frame.

SUMMARY OF THE INVENTION

According to a first aspect of the present invention, a garage door position indicating system is provided comprising means for detecting a change in orientation of a garage door and supplying a signal when the garage door changes orientation from generally vertical to generally horizontal and from generally horizontal to generally vertical; means, coupled to the detecting means, for transmitting an RF signal in response to the signal supplied by the detecting means; means for receiving the RF signal generated by the transmitting means; and means, coupled to the receiving means, for indicating the position of the garage door in response to the received RF signal.

According to a second aspect of the present invention, a garage door position indicating system is provided comprising a tilt switch attached to a garage door, the tilt switch operative to supply an enable signal at selected first tilt positions and to block the enable signal at selected second tilt positions, an RF transmitter coupled to the tilt switch and operative to generate an RF signal in response to the enable signal, an RF receiver responsive to the RF signal, and an indicator controlled by the RF receiver to indicate position of the garage door.

In the preferred embodiment of the invention, the tilt switch comprises a mercury switch mounted at an angle to the garage door such that the mercury switch is nonconducting both when the garage door is generally vertical and when the garage door is generally horizontal.

DETAILED DESCRIPTION OF THE PRESENTLY PREFERRED EMBODIMENTS

Figure 1:
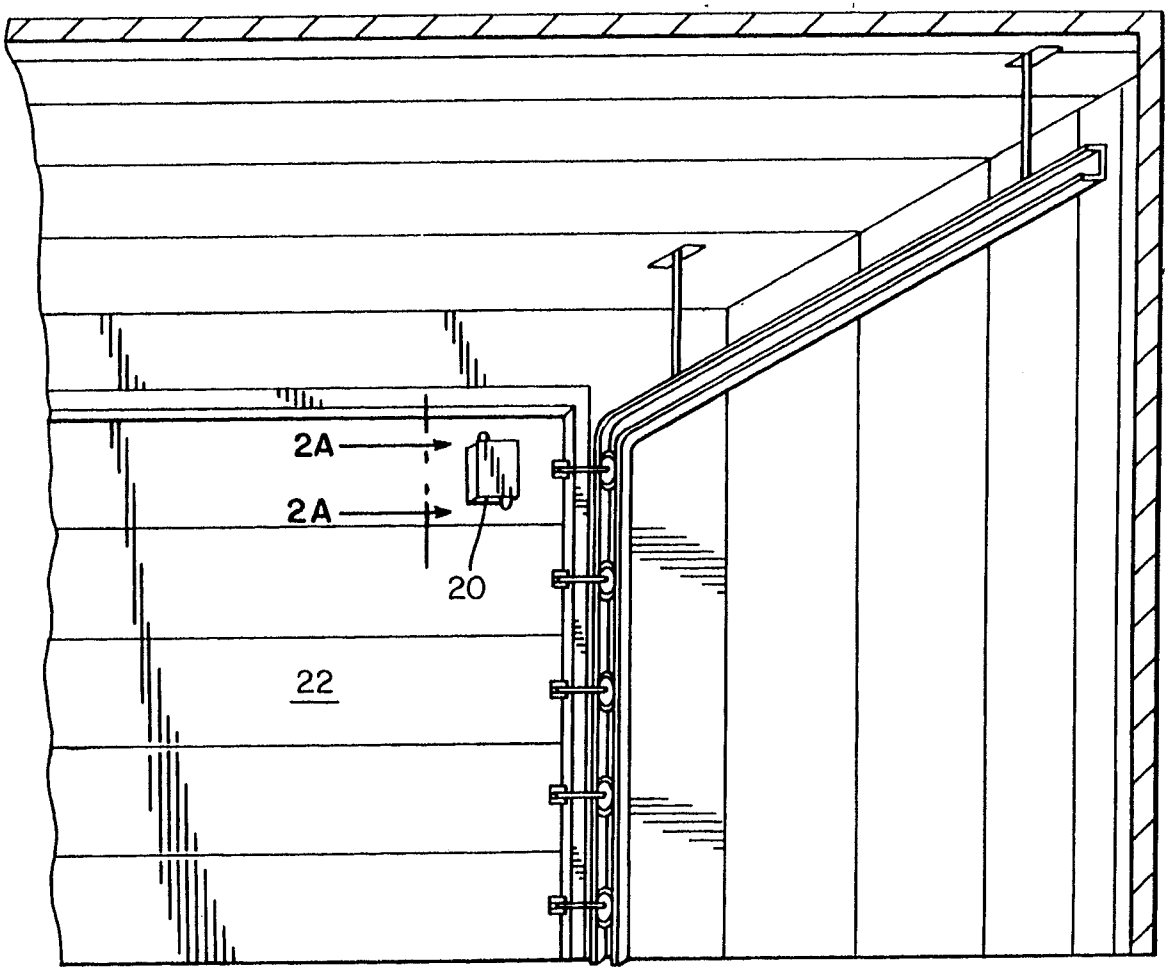
FIG. 1 is a perspective view of an RF transmitter unit mounted on a garage door.
Figure 2:
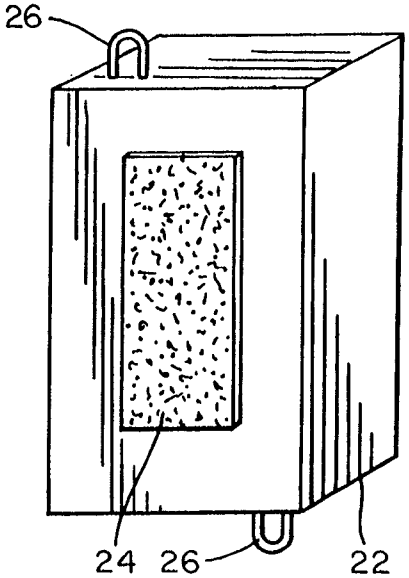
FIG. 2 is a perspective view of the RF transmitter unit of FIG. 1.

Referring now to the figures, FIG. 1 shows an RF transmitter unit 20 mounted on the inside of an overhead garage door 22. The RF transmitter unit 20 is light weight and may easily be mounted using a hook and loop fastener 24 such as that sold under the trade name VELCRO (FIG. 2). Alternatively, the RF transmitter unit 20 may be mounted with wood screws through eyelets 26. In alternate embodiments, adhesives such as pressure sensitive tapes may be used to secure the RF transmitter unit 20 to the door 22.

Figures 2A, 2B, 2C:
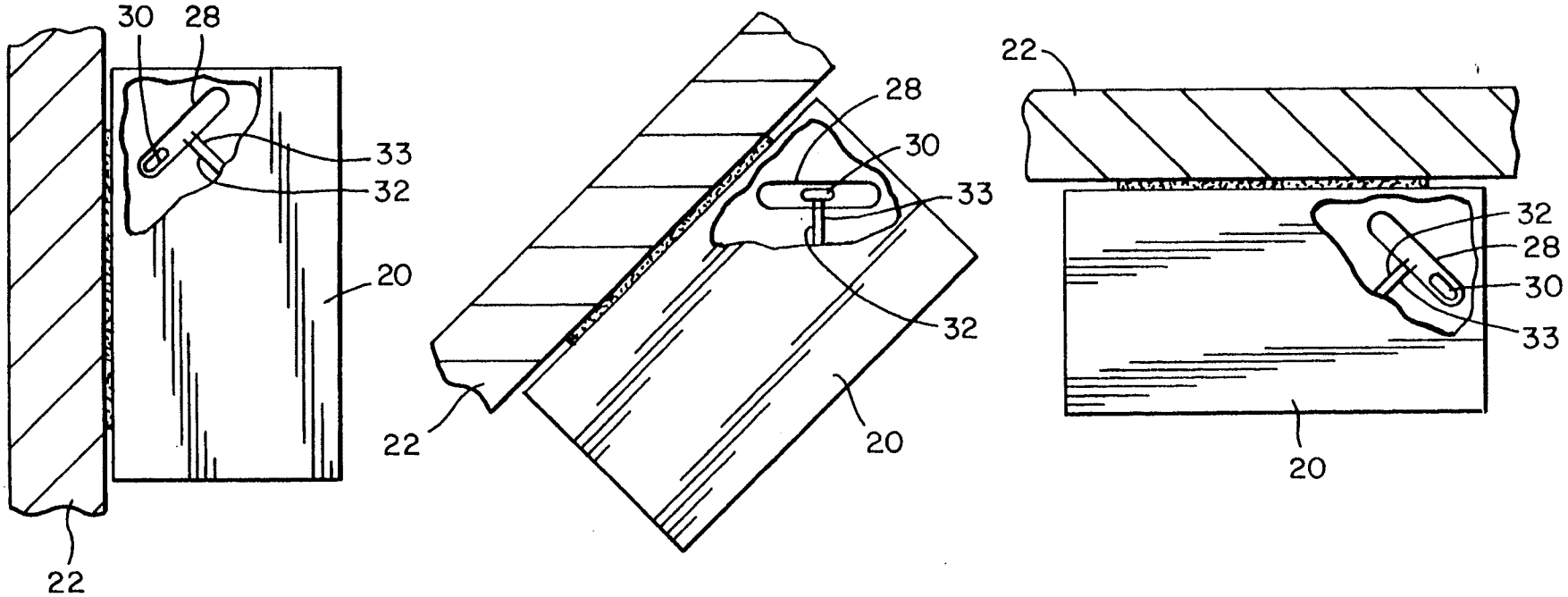
FIG. 2A is a cross-sectional view taken along line 2A—2A of FIG. 1 with the garage door in a generally vertical position.
FIG. 2B is a cross-sectional view corresponding to that of FIG. 2A with the garage door at an angle to the generally vertical position.
FIG. 2C is a cross-sectional view corresponding to that of FIG. 2A with the garage door in a generally horizontal position.

When the garage door 22 is in the generally vertical position, such as when the door is closed, the garage door 22 and RF transmitter unit 20 are oriented as shown in FIG. 2A. Enclosed within the RF transmitter unit 20 is a mercury switch 28. The mercury switch 28 comprises two electrical contacts 32 and 33 that are located near the center of the switch and a bead of mercury 30. An enable signal, which may correspond either to a control signal or an operating voltage supplied by power supply 34, is present on contact 32. The mercury 30 is capable of moving within the mercury switch 28 and is of such dimension that it is capable of contacting electrical contacts 32 and 33 simultaneously. The mercury switch 28 is oriented within the RF transmitter unit 20 such that when the garage door 22 is in the generally vertical position, as shown in FIG. 2A, the force of gravity causes the bead of mercury 30 to move to a position where it does not make simultaneous contact with electrical contacts 32 and 33, thereby blocking the enable signal.

As the garage door 22 changes orientation either from generally vertical to generally horizontal or from generally horizontal to generally vertical, the force of gravity will cause the bead of mercury 30 to move within the mercury switch 28 into a position where it simultaneously contacts electrical contacts 32 and 33 as shown in FIG. 2B, thereby supplying the enable signal to contact 33.

When the garage door 22 reaches the generally horizontal orientation, the force of gravity again causes the bead of mercury 30 to move to a position where it does not make simultaneous contact with electrical contacts 32 and 33 as shown in FIG. 2C and the enable signal on contact 32 is again blocked.

Figure 3A:
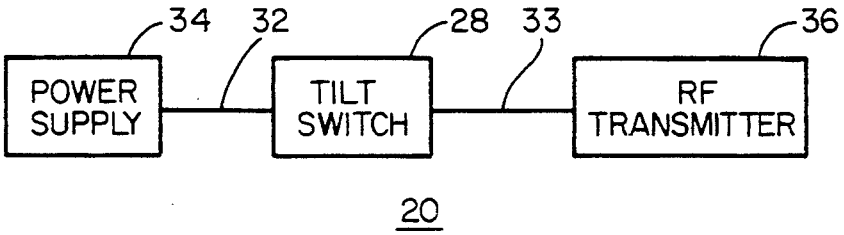
FIG. 3A is a block diagram of the RF transmitter unit of FIG. 1.

The elements of the preferred embodiment of the RF transmitter unit 20 are represented in the block diagram of FIG. 3A. The RF transmitter unit 20 comprises a power supply 34 coupled via the electrical contact 32 to a tilt switch such as the mercury switch 28. The tilt switch is coupled via the electrical contact 33 to an RF transmitter 36. As the garage door 22 changes orientation either from generally vertical to generally horizontal or from generally horizontal to generally vertical, the force of gravity will cause the bead of mercury 30 to move within the mercury switch 28 into a position where it simultaneously contacts electrical contacts 32 and 33 as shown in FIG. 2B, thereby supplying the enable signal to contact 33 and therefore to the RF transmitter 36, which generates an RF signal in response to the enable signal.

With reference to FIGS. 2A through 2C, it will be appreciated that the mercury switch 28 is closed, thereby conducting power from the power supply 34 to the RF transmitter 36, only for that time period when the bead of mercury 30 simultaneously contacts electrical contacts 32 and 33 (FIG. 2B). Thus, the angled orientation of the mercury switch 28 results in intermittent operation of the RF transmitter 36 and reduced power drain on the power supply 34. The RF transmitter 36 does not continuously draw from the power supply 34 when the garage door is in either the horizontal or the vertical position; rather, the RF transmitter 36 draws power and transmits an RF signal only when the mercury switch 28 is closed.

Where the garage door 22 comprises a sectional door, it is preferable to mount the RF transmitter unit 20 near the top of the garage door 22 such that the RF transmitter 36 is activated before the garage door 22 is significantly raised. In addition, the power supply 34 is preferably a battery, which greatly simplifies installation of the RF transmitter unit 20 by eliminating the need to connect the transmitter unit 20 to an external power source.

Furthermore, it will be appreciated that the sensitivity of the RF transmitter unit 20 to a change in position of the garage door 22 varies with the angle of the mercury switch 28 to the door 22. Sensitivity, as used herein, relates to that angle through which the RF transmitter unit 20 must be rotated to close the mercury switch 28 and supply power from the power supply 34 to the RF transmitter 36. For instance, when the mercury switch 28 is mounted at an angle of sixty degrees to the garage door 22, the RF transmitter unit 20 will transmit the RF signal after being rotated through a smaller angle from the vertical position than would be required for an RF transmitter unit 20 having the mercury switch 28 mounted at an angle of thirty degrees to the door. The angle between the garage door 22 and the mercury switch 28 defines the tilt position of the switch 28, and the tilt position can be selected to obtain the desired system sensitivity.

Once the RF transmitter unit 20 is triggered by the change in orientation of the garage door 22, the transmitter unit 20 transmits the RF signal. An RF receiver unit 52 receives the transmitted signal at a remote location and indicates the change in position of the garage door.

Figure 3B:
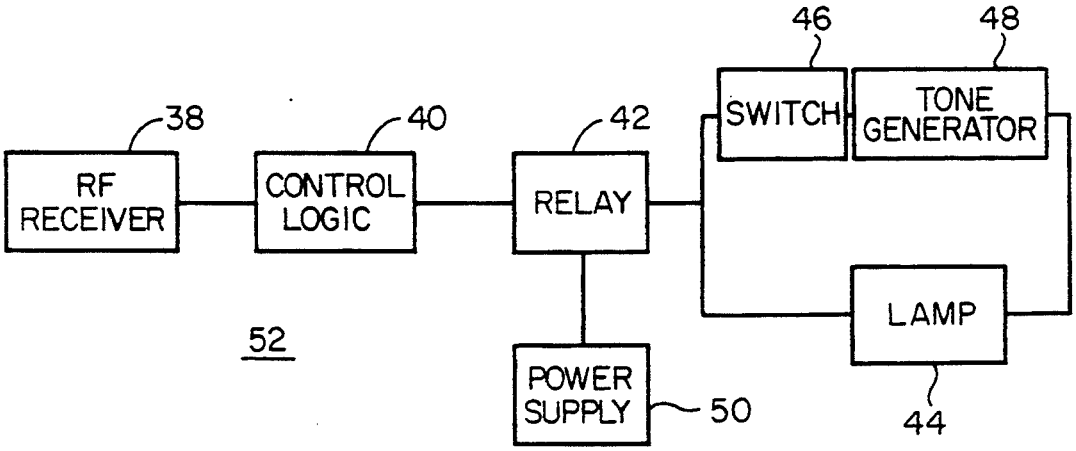
FIG. 3B is a block diagram of an RF receiver unit adapted for use with the RF transmitter unit of FIG. 1.

The elements of the RF receiver unit 52 are represented in the block diagram of FIG. 3B. An RF receiver 38 is coupled to control logic 40 which generates a control signal having two states. The control logic 40 is coupled to relay 42 which is capable of assuming two states in response to the control signal generated by the control logic 40. A power supply 50 is coupled to the relay 42. The relay 42 is coupled to switch 46, which is connected in series with tone generator 48. A lamp 44 is coupled to relay 42 in parallel with the series connected switch 46 and tone generator 48. In the first one of the two states that the relay 42 may assume, the power supply 50 is coupled through the relay 42 to the switch 46 and the lamp 44. In the second one of the two states that the relay 42 may assume, the power supply 50 is isolated from the switch 46 and the lamp 44.

The control logic 40 and the relay 42 cooperate to change the state of the relay 42 in response to each RF signal received by the RF receiver. For example, if an RF signal is received while the relay 42 is in the first state, then the control logic 40 will cause the relay 42 to change to the second state to turn off the lamp 44. Similarly, if an RF signal is received while the relay 42 is in the second state, then the control logic 40 will cause the relay 42 to change to the first state to turn on the lamp 44. Thus, each time the garage door 22 changes position (either to the closed position or to the open position) the RF transmitter unit 20 will send an RF signal that causes the lamp 44 to be turned off if it was previously on and on if it was previously off.

Preferably, the control logic 40 generates a control signal causing the relay 42 to assume the second one of the two states when power is initially supplied to the RF receiver unit 52. Therefore, the garage door 22 should be closed, that is, in the generally vertical position, when power is initially supplied to the RF receiver unit 52. When installed in this manner, the lamp 44 and, if switch 46 is closed, the tone generator 48 are turned on when the garage door 22 is raised and turned off when the door 22 is lowered.

The lamp 44 is preferably a light emitting diode. The power supply 50 of the RF receiver unit 52 preferably includes a 110 V AC source reduced to 24 V DC by an appropriate rectifying matrix, such that the RF receiver unit 52 is capable of being plugged into any 110 V outlet in the home. The RF transmitter and the RF receiver are preferably capable of transmitting and receiving, respectively, a coded RF signal wherein the code may be set by the system user such as by setting DIP switches provided with the transmitter and receiver units.

The relay 42 is preferably a ratcheting relay having two inputs and three outputs. The first input may be coupled to the control signal supplied by the control logic 40, and the second input may be coupled to the power supply 50. Ratcheting relays are capable of assuming two states. In the first one of the two states, the first output, which is coupled to the lamp 44 and the switch 46, is connected to the second output, which is grounded. In the second one of the two states the first output is coupled to the power supply 50.

In an alternative embodiment of the present invention, the RF transmitter 36 is capable of transmitting two different RF signals in response to enable signals from two separate tilt switches. A first one of the two RF signals is transmitted when the garage door 22 is oriented in the vertical position, and a second one of the two RF signals is transmitted when the door 22 is oriented at an angle to the vertical position. The RF receiver 38 is capable of receiving and distinguishing between the two RF signals such that the system indicates the absolute position of the garage door 22.

The garage door position indicating systems described above are easy to install. The RF transmitter unit 20 may be installed without the use of tools and may be angled to a certain extent with respect to the door without impairing operation of the system. In addition, there is no need to align or mechanically connect the RF transmitter unit 20 to the adjacent door jamb or other support. Similarly, the RF receiver unit 52 is quickly and easily installed by plugging it into any 110 V household outlet. The systems described above indicate when the garage door 22 has been inadvertently left open as a security device.

It should be appreciated that the garage door position indicating system of this invention may be configured as appropriate for the application. The embodiments described above are to be considered in all respects only as illustrative and not restrictive. The scope of the invention is indicated by the following claims rather than by the foregoing description. All changes which come within the meaning and range of equivalency of the claims are to be embraced within their scope.

I claim:

1. An indicating system for remotely providing an indication of an open or closed position of a garage door, comprising:

a transmitter unit including a housing mountable to the garage door, the housing enclosing: a tilt switch for generating a first signal when the garage door changes orientation from generally vertical to generally horizontal and for generating a second signal when the garage door changes orientation from generally horizontal to generally vertical; an RF transmitter coupled to the tilt switch and responsive to one of said first and second signals for transmitting one of first and second RF signals during the respective duration of said first and second signal; and a receiver unit including an RF receiver responsive to either of said first and second transmitted RF signals and an indicating means coupled to the RF receiver, the indicating means being activated by receipt of either of said first and second RF signals by the receiver, and deactivated by receipt of the other of said first and second signals by the receiver, whereby activation or deactivation of the indicating means indicates the position of the door.

2. An indicating system as recited in claim 1, wherein the tilt switch comprises a center-contacted mercury switch.

3. An indicating system as recited in claim 2, wherein the mercury switch is mounted at an angle to the garage door such that the mercury switch is nonconducting both when the garage door is generally vertical and when the garage door is generally horizontal and is conducting when the garage door is in a position intermediate vertical and horizontal.

4. An indicating system as recited in claim 3, wherein the tilt switch generates one of said first and second signals when the garage door passes in either direction through the intermediate position.

5. An indicating system as recited in claim 1, wherein the indicating means comprises:

a ratcheting relay coupled to the RF receiver, the ratcheting relay capable of assuming two states in response to a control signal generated by the RF receiver; and a visual indicator coupled to the ratcheting relay, the visual indicator being energized when the ratcheting relay is in a first one of the two states and deenergized when the ratcheting relay is in a second one of the two states.

6. An indicating system as recited in claim 5, wherein the indicating means further comprises a tone generator coupled through a manually operable switch to the visual indicator such that a tone is generated when the visual indicator is energized and the switch is closed.

7. A garage door position indicating system as recited in claim 1, wherein the receiver unit is adapted to be plugged into an electrical socket.

8. A garage door position indicating system as recited in claim 1, wherein the receiver unit is battery powered.

* * * * *